United States Patent [19]

Hawkins et al.

[11] Patent Number: 4,633,850

[45] Date of Patent: Jan. 6, 1987

[54] RANGE OVEN VENT SYSTEM

[75] Inventors: Ralph G. Hawkins; George Fields, Jr., both of Louisville, Ky.

[73] Assignee: General Electric Company, Louisville, Ky.

[21] Appl. No.: 803,620

[22] Filed: Dec. 2, 1985

[51] Int. Cl.[4] ..... F24C 15/32

[52] U.S. Cl. ..... 126/21 R; 126/19 R; 126/273 R; 219/400

[58] Field of Search ..... 126/19 R, 21 R, 21 A, 126/24, 273 R, 214 R, 214 A, 214 B, 214 C, 214 D, 299 D; 98/115.1; 219/385, 391, 396, 400

[56] References Cited

U.S. PATENT DOCUMENTS

| | | | |
|---|---|---|---|
| Re. 26,944 | 8/1970 | Getman | 219/397 X |
| 2,337,349 | 12/1943 | Rees | 126/21 R |
| 2,674,991 | 4/1954 | Schaefer | 126/299 |
| 3,051,158 | 8/1962 | Kimberley | 126/21 |
| 3,165,201 | 1/1965 | Woodman | 206/56 |
| 3,367,316 | 2/1968 | Eff | 126/21 R |
| 3,410,987 | 11/1968 | Hurko et al. | 219/397 |
| 3,440,401 | 4/1969 | Dills | 126/19 R X |
| 3,583,384 | 6/1971 | Ranisate | 126/24 |
| 3,847,135 | 11/1974 | Sherman | 126/21 |
| 3,963,414 | 6/1976 | Jensen | 431/329 |
| 4,547,642 | 10/1985 | Smith | 126/21 A X |

*Primary Examiner*—Margaret A. Focarino

*Attorney, Agent, or Firm*—Frank P. Giacalone; Radford M. Reams

[57] ABSTRACT

A domestic cooking appliance vent system including a first vertical vent conduit communicating with the oven, extending through a support plate, and a second vertical conduit that is located above the first conduit but horizontally offset therefrom. A horizontal adapter duct positioned in a locating area on the support plate joins the first vent conduit with the second vent conduit. The adapter duct includes a continuous side wall, a top wall forming an open bottom positioned over the first vertical duct and a top vent opening in one end of the top wall communicating with the second vertical conduit. The support area and adapter duct is dimensioned so that its position in the locating area insures that the top vent opening in the adapter duct is axially aligned with the second vertical conduit.

8 Claims, 3 Drawing Figures

RANGE OVEN VENT SYSTEM

BACKGROUND OF THE INVENTION

The present invention relates to a domestic cooking appliance and more particularly to vent systems for ovens wherein a cooktop, including surface units, is arranged over the oven. The appliance has a first vertical oven vent conduit communicating with the oven and a second vertical conduit in the form of a surface unit assembly located above the first duct but horizontally offset therefrom so that inadvertent spillage into the surface unit assembly will not pass through the first vertical vent conduit. Accordingly, an offset adapter duct is employed to join the top end of the first vertical conduit and the lower end of the second vertical conduit.

In ranges employing an offset adapter duct it is customary to arrange it so that it may be removed for cleaning due to spillage or other overflow which may contaminate the area between the first and second vertical conduits. One disadvantage to this procedure is that some people have experienced difficulties in being able to reassemble the adapter duct in its proper orientation relative to the offset vertical conduits once it has been removed for cleaning. This difficulty in replacing the adapter duct in its proper orientation relative to the first and second vertical conduits causes some people to discard or not replace the adapter duct. The absence of an adapter duct or in the event it is arranged so that the first and second vertical conduits are not vertically aligned may cause damage in the area between the vertical conduits due to the accumulation of condensation and also a safety problem may be present if this oven is a high temperature, pyrolytic, self-cleaning oven where the oven exhaust gases might reach temperatures approaching 1,000° F. and these relatively hot gases are not directed to the second vertical conduit. The absence of the adapter duct might in some instances allow the oven exhaust gases to spread out under the range cooktop and discharge the oven soils and greases onto the electrical components of the range. Moreover, the cooktop might become overheated and cause inadvertent burns to the user of the range during operation of the oven.

The principal object of the present invention is to provide an oven vent system with an adapter duct arrangement in which the user visually ascertains proper positioning thereof.

SUMMARY OF THE INVENTION

The present invention relates to a domestic cooking appliance including an oven surrounded by an insulated outer cabinet and more particularly to a venting system for the oven. Arranged adjacent to the upper portion of the oven is a horizontal support plate. Extending through the support plate is a first vertical oven vent conduit having its lower end communicating with the upper portion of the oven. A second vertical conduit located above the upper portion of the first duct but horizontally offset therefrom serves as an extension of the first conduit. An elongated adapter duct having an enlarged end is arranged in a locating area on the support plate so as to extend horizontally between the first vertical conduit and the second vertical conduit. The adapter duct includes a continuous side wall, a top wall including a vent opening adjacent the narrow end and having an open bottom communicating with the support plate and encompassing the upper end of the first vertical conduit. The support plate locating area is substantially the same dimension and configuration as the adapter duct so that when the adapter duct is properly arranged in the locating area the vent opening in the top wall of the adapter duct is aligned with the second conduit and the first conduit is in communication with the open bottom of the adapter duct.

DESCRIPTION OF THE PREFERRED EMBODIMENT

Figure 1:
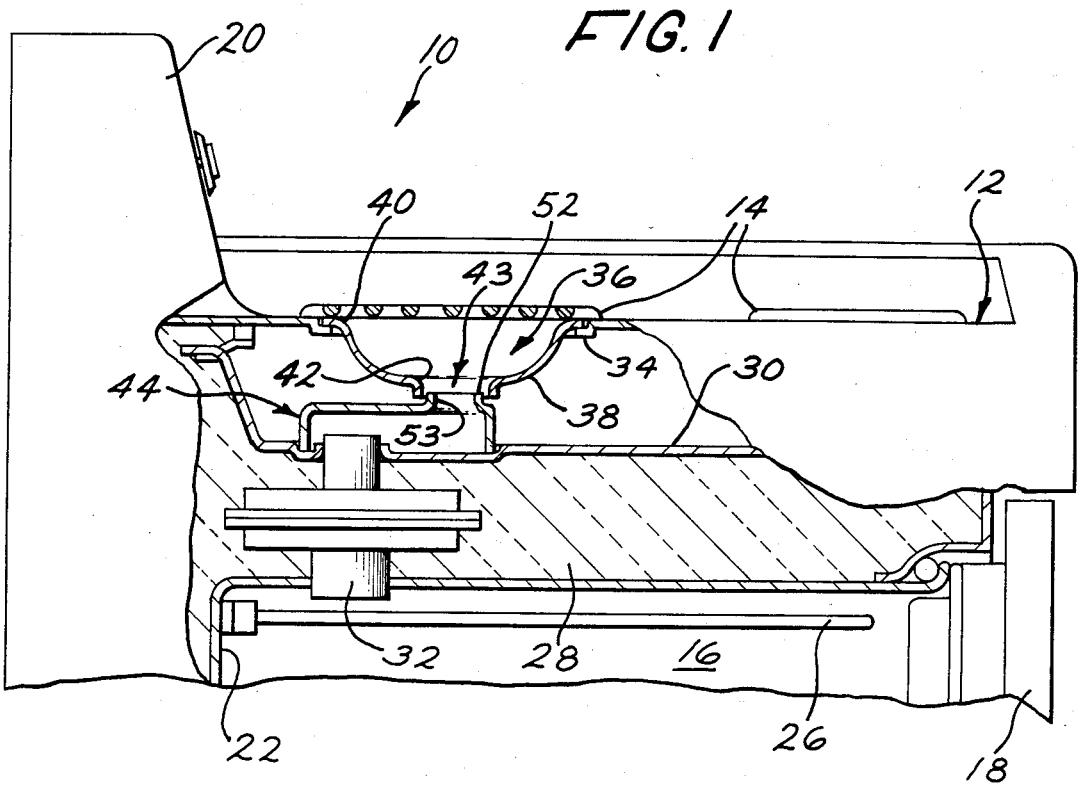
FIG. 1 is a fragmentary, side elevational view of an electrical range with parts broken away and some in cross-section to show the oven vent system incorporating the present invention.

Referring now to the drawings and particularly to FIG. 1, there is shown an electric range 10 having a top cooking surface 12 with a plurality of surface heating elements 14, an oven cavity 16, a front-opening drop door 18 for the oven, and a backsplasher 20 arranged along the back edge of the cooking surface 12 and containing a control panel in the front face thereof which may include a plurality of settable control devices (not shown) which control the energization of the various heating elements of the range. The oven cavity 16 is formed by a boxlike oven liner 22 that has an open front that is adapted to be closed by the oven door 18. As in standard electric ovens, there is a lower heating or bake unit (not shown) and an upper or broil unit 26. The oven liner 22 is insulated from the range body 10 by a blanket of insulation 28 completely surrounding the oven liner. The top of the insulation is covered with a shallow pan or plate 30 that also serves to catch and retain any food soils that might spill or overflow through the openings in the surface heating units 14.

The oven cooking cavity 16 has a vertical oven vent conduit 32 near the back of the oven which extends up through the layer of insulation 28, and through the plate 30. The vent duct 32 will be referred to as the first vertical conduit. The upper end of the vent conduit 32 rises above the plate 30 so that if there is any accumulation of spillage in the plate 30 it will not flow into the conduit 32.

The surface units 14 are supported in a ledge forming a recess 34 surrounding an opening 36 formed in the cooking surface 12. Positioned in the opening 36 is a reflector pan 38. The reflector pan 38 is a slight dished formation with a horizontal peripheral flange 40 across its top edge resting on the ledge of the recess 34 with the surface unit 14 in fact resting on the flange 40 of pan 38. As shown in the drawing, the central lower portion of the reflector pan 38 is cut-out as at 42, and it is this reflector pan cut-out 42 and its associated structure that forms the second vertical conduit 43 that was mentioned previously as being located above the first vertical duct 32, but horizontally offset therefrom. An adapter duct 44, as will be explained hereinbelow, provides communication between the first vertical conduit 32 and the horizontally offset second vertical conduit 43.

The present invention is related to the horizontal adapter duct 44 and the means for locating the duct relative to the first and second vertical conduit 32 and 43 respectively so as to insure communication therebetween so that gases issuing from the oven through conduit 32 will always be directed out of the range through the surface unit 14, forming conduit 43.

Figure 2:
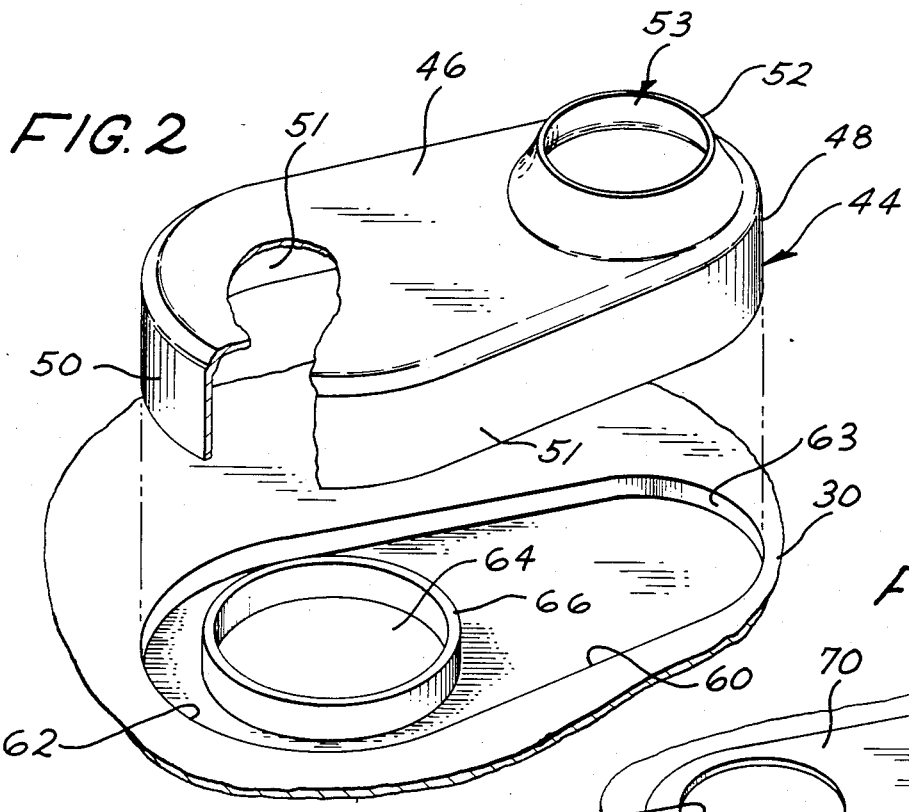
FIG. 2 is an exploded perspective view showing details of the oven vent system.

Referring now to FIG. 2, it will be seen that the duct 44 is a generally hollow member of inverted oblong box-like form having a top wall 46, opposite end walls 48 and 50, and opposite side walls 51 with the bottom portion being open. The adapter duct 44 is supported on the plate 30 so as to overlie the upper end of the duct 32 and underlie the bottom portion of duct 43 represented by opening 42 of reflector pan 38. The top wall 46 of the adapter duct 44 is provided with a circular opening 53 that is formed by a raised collar 52 which telescopes slightly into the opening 42 at the lower portion of reflector pan 38. With the duct 44 properly arranged as shown in FIG. 1, the side walls thereof encompass the upper end of conduit 32 and the collar 52 located adjacent to the end wall 48 is telescoped relative to opening 38.

The duct 44 as thus far described provides communication between the first vertical conduit 32 and the second vertical conduit 43 and is removable from its position on the plate 30 so that it and the plate may be cleaned. By the present invention means are provided which encourages the placement of the duct 44 on the plate 30 in a manner that insures communication between the ducts 32 and 43.

Figure 3:
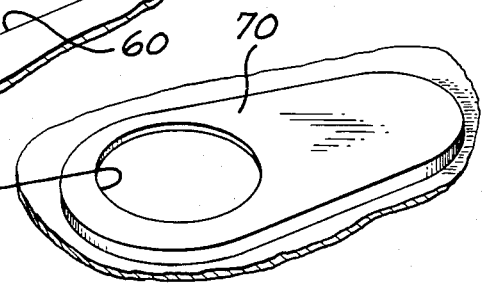
FIG. 3 is a perspective view showing another embodiment of the invention.

To this end, as shown in FIG 2, one end of the duct 44 adjacent wall 50 of duct 44 is enlarged relative to portion of duct 44 adjacent end wall 48 so that the side walls 51 converge toward the end wall 48. The plate 30 is formed to include a locating means dimensioned to properly orient the duct 44 as shown in the drawings. To this end the plate 30 includes an elongated or oblong recess 60 which is substantially shaped and dimensioned to receive the duct 44. Accordingly, it includes an enlarged area 62 dimensioned to receive the enlarged area of the duct 44 adjacent the end 50 and a smaller area 63 dimensioned to receive smaller portion of the duct 44 adjacent the end 48. Located in the enlarged area 62 is a circular opening 64 that is formed by a raised collar 66 in which the upper end of conduit 32 is located. The duct 44 can be placed in recess 60 only in the orientation that places the opening 53 in axial alignment with the conduit 43 as shown in FIG. 1. In the alternative, the locating means may take the form of a raised portion 70 as shown in FIG. 3. In this instance the portion 70 like recess 60 is substantially shaped and dimensioned to receive the duct in its proper orientation relative to the ducts 32 and 43.

In summary, in the event an attempt is made to arrange the duct 44 in a position other than with the vent opening 53 axially aligned with the opening 42, the duct 44 will not be in its design location in the recess 60. Its misaligned position relative to recess 60 will be readily apparent and its correct positioning in the recess 60 therefore encouraged.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A domestic cooking appliance including an oven surrounded by an insulated outer cabinet, and a venting system for said oven, comprising;

a horizontal support plate adjacent to the upper portion of said oven;

a first vertical oven vent conduit having its lower end communicating with the upper portion of said oven and an upper portion extending through said support plate;

a second vertical conduit located above said upper portion of said first conduit but horizontally offset therefrom to serve as an extension of said first conduit;

a horizontal elongated adapter duct removably supported on said support plate extending between said first vertical conduit and said second vertical conduit, said elongated adapter duct including a body portion having a top wall, side wall and end walls defining an open bottom communicating with said first vertical conduit extending through said support plate; the end portion of said adapter duct adjacent one of said end walls including an enlargement relative to the end portion of said duct adjacent the other end wall;

a vent opening in said top wall of said adapter duct being aligned with said second vertical conduit; and an elongated locating means on said support plate, including side walls and end walls formed to provide an enlarged area adjacent one of said end walls relative to the end portion adjacent the other end wall dimensioned to receive said enlargement of said adapter duct so that when said adapter duct is in said locating means said vent opening in said adapter duct is aligned with said second vertical conduit and said first vertical conduit is communicating with the open bottom of said adapter duct.

2. The domestic cooking appliance recited in claim 1 wherein said adapter duct includes a continuous wall depending from said top wall.

3. The domestic cooking appliance recited in claim 2 wherein said locating means includes a recess having an upwardly extending continuous side wall dimensioned to receive said adapter duct continuous wall.

4. The domestic cooking appliance recited in claim 3 wherein said one of said end walls of adapter duct adjacent said enlargement is arcuate.

5. The domestic cooking appliance recited in claim 4 wherein said side walls converge from said arcuate enlargement toward said other of said end walls.

6. The domestic cooking appliance recited in claim 2 wherein said locating means includes a raised portion having an upwardly extending continuous side wall dimensioned to be received in said adapter duct continuous wall.

7. The domestic cooking appliance recited in claim 6 wherein said one of said end walls of said adapter duct adjacent said enlargement is arcuate.

8. The domestic cooking appliance recited in claim 7 wherein said side walls converge from said arcuate enlargement toward said other of said end walls.

* * * * *